US006873819B2

(12) United States Patent
Ahn et al.

(10) Patent No.: US 6,873,819 B2
(45) Date of Patent: Mar. 29, 2005

(54) WASTED TONER STORING APPARATUS OF AN IMAGE FORMING APPARATUS HAVING A ROTATING DISPERSING MEMBER

(75) Inventors: Byeong-hwa Ahn, Gyeongi-do (KR); Young-min Yoon, Gyeonggi-do (KR); Woo-chul Jung, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/633,316

(22) Filed: Aug. 4, 2003

(65) Prior Publication Data

US 2004/0096251 A1 May 20, 2004

(30) Foreign Application Priority Data

Sep. 6, 2002 (KR) ..... 10-2002-0053822

(51) Int. Cl.[7] ..... G03G 21/12
(52) U.S. Cl. ..... 399/360

(58) Field of Search ..... 399/360, 120, 399/391, 392, 393, 358, 257

(56) References Cited

U.S. PATENT DOCUMENTS 6,353,722 B1 * 3/2002 Klimley et al. ..... 399/257
6,546,225 B2 * 4/2003 Wang ..... 399/358

FOREIGN PATENT DOCUMENTS

JP 5-232846 9/1993
JP 11-305623 11/1999

* cited by examiner

*Primary Examiner*—Quana Grainger
(74) *Attorney, Agent, or Firm*—Staas & Halsey LLP

(57) ABSTRACT

A wasted toner storing apparatus and a dry type electrophotographic image forming apparatus using the same. The wasted toner storing apparatus includes a wasted toner container accommodating wasted toner generated during a printing process, and a dispersing member inside the wasted toner container, dispersing the wasted toner inside the wasted toner container by rotation of the dispersing member.

16 Claims, 3 Drawing Sheets

WASTED TONER STORING APPARATUS OF AN IMAGE FORMING APPARATUS HAVING A ROTATING DISPERSING MEMBER

CROSS-REFERENCE TO RELATED APPLICATIONS

This application claims the benefit of Korean Application No. 2002-53822, filed Sep. 6, 2002, in the Korean Intellectual Property Office, the disclosure of which is incorporated herein by reference.

BACKGROUND OF THE INVENTION

1. Field of the Invention

The present invention relates to a dry type electrophotographic image forming apparatus, and, more particularly, to a dry type electrophotographic image forming apparatus having a wasted toner storing apparatus for storing wasted toner generated during image formation.

2. Description of the Related Art

An electrophotographic image forming apparatus completes an image print by forming an electrostatic latent image on a photosensitive medium, developing the electrostatic latent image using a developing agent, and transferring the developed image to a sheet of print paper via a predetermined transfer medium. Of the different types of electrophotographic image forming apparatuses, an apparatus using toner in a powder state as a developing agent is referred to as a dry type electrophotographic image forming apparatus.

FIG. 1 shows one example of a dry type electrophotographic image forming apparatus.

The image forming apparatus shown in FIG. 1 includes a photoreceptor drum 10 as a photosensitive medium, a charger 13 for charging the photoreceptor drum 10, an exposing unit 12 for scanning light onto the charged photoreceptor drum 10 to form an electrostatic latent image, a developing unit 11 for supplying color toner to the electrostatic latent image to form a toner image, a transferring unit 16 for transferring the toner image to a sheet of print paper S, and a fixing unit 17 for heating and pressing the print paper S to fix the toner image on the print paper S.

In the above image forming apparatus, since a portion of the toner adhered to the electrostatic latent image is not transferred to the print paper S but generally remains on the surface of the photoreceptor drum 10, the remaining toner must be removed from the photoreceptor drum 10 before the next print job. Reference numeral 14 represents a cleaning member. The cleaning member 14 is in contact with the surface of the photoreceptor drum 10 and scrapes off the toner remaining on the surface of the photoreceptor drum 10 by way of the rotation of the photoreceptor drum 10. Wasted toner T removed from the photoreceptor drum 10 is collected in a container, which is indicated by reference numeral 18, and the wasted toner T is transported into a wasted toner container 20 by a transporting unit 15 installed in the container 18.

FIG. 2 is a perspective view of the wasted toner container 20 shown in FIG. 1 in detail.

With reference to FIG. 2, one end of the transporting unit 15 is fixed to an inlet 21 of the wasted toner container 20, and the wasted toner T transported from the container 18 by the transporting unit 15 enters into the wasted toner container 20 via the inlet 21. The wasted toner T free-falls into and accumulates in the wasted toner container 20 due to the force of gravity. However, the wasted toner T is not evenly dispersed inside the wasted toner container 20, and most of the wasted toner T accumulates in the lower portion of the inlet 21. If the wasted toner T has piled up to the upper portion of the inlet 21 as shown in FIG. 2, though enough space for accommodating the wasted toner T exists inside the wasted toner container 20, the wasted toner container 20 cannot accommodate the wasted toner T because the inlet 21 of the wasted toner container 20 is clogged with the wasted toner T. As a result, the wasted toner T removed from the photoreceptor drum 10 is not transported into the wasted toner container 20, and instead the wasted toner T accumulates in the container 18. However, if the capacity of the container 18 for accommodating the wasted toner is exceeded, the wasted toner T leaks outside the container 18, whereby the image forming apparatus can be polluted.

In order to prevent this problem, there has been proposed a first method requiring a user to periodically shake the wasted toner container 20 to disperse the wasted toner T, and a second method of installing an individual wasted toner container driving device (not shown) which disperses the accumulated wasted toner T inside the wasted toner container 20 by vibrating the wasted toner container 20. However, in the first method, since the user must remember the dispersion period of the wasted toner T, this method is not convenient for the user. In a case where the user forgets the dispersion period of the wasted toner T, the wasted toner T leaks.

Further, in the second method, in a case of vibrating the wasted toner container 20, the one end of the transporting unit 15 may be separated from the inlet 21 such that the wasted toner T transported from the container 18 may not enter into the wasted toner container 20, whereby the inside the image forming apparatus may be polluted.

SUMMARY OF THE INVENTION

The present invention provides a dry type electrophotographic wasted toner storing apparatus improved to be capable of evenly dispersing wasted toner inside a wasted toner container without vibrating the wasted toner container, and a dry type electrophotographic image forming apparatus adopting the same.

Additional aspects and/or advantages of the invention will be set forth in part in the description which follows and, in part, will be obvious from the description, or may be learned by practice of the invention.

According to an aspect of the present invention, there is provided a wasted toner storing apparatus of a dry type electrophotographic image forming apparatus comprising a wasted toner container which accommodates wasted toner generated in a print unit for printing an image on a print paper by an electrophotographic method using dry toner; and a dispersing member inside the wasted toner container that disperses the wasted toner inside the wasted toner container by rotation of the dispersing member.

According to another aspect of the present invention, there is provided a dry type electrophotographic image forming apparatus comprising a print unit for printing an image on a print paper by an electrophotographic method using dry toner; and a wasted toner storing apparatus container for storing wasted toner generated in the print unit, wherein the wasted toner storing apparatus includes a wasted toner container for accommodating the wasted toner, and a dispersing member inside the wasted toner container that disperses the wasted toner inside the wasted toner container by rotation of the dispersing member.

The image forming apparatus further comprises a feeding cassette which is installed/removed in/from the print unit for accommodating the print paper to be supplied to the print unit, and the dispersing member is coupled with the cassette so as to rotate during an installing/removing operation of the feeding cassette.

The dispersing member may include a rotation axis inside the wasted toner container and a plurality of spiral protrusions which are disposed on the rotation axis to disperse the wasted toner.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
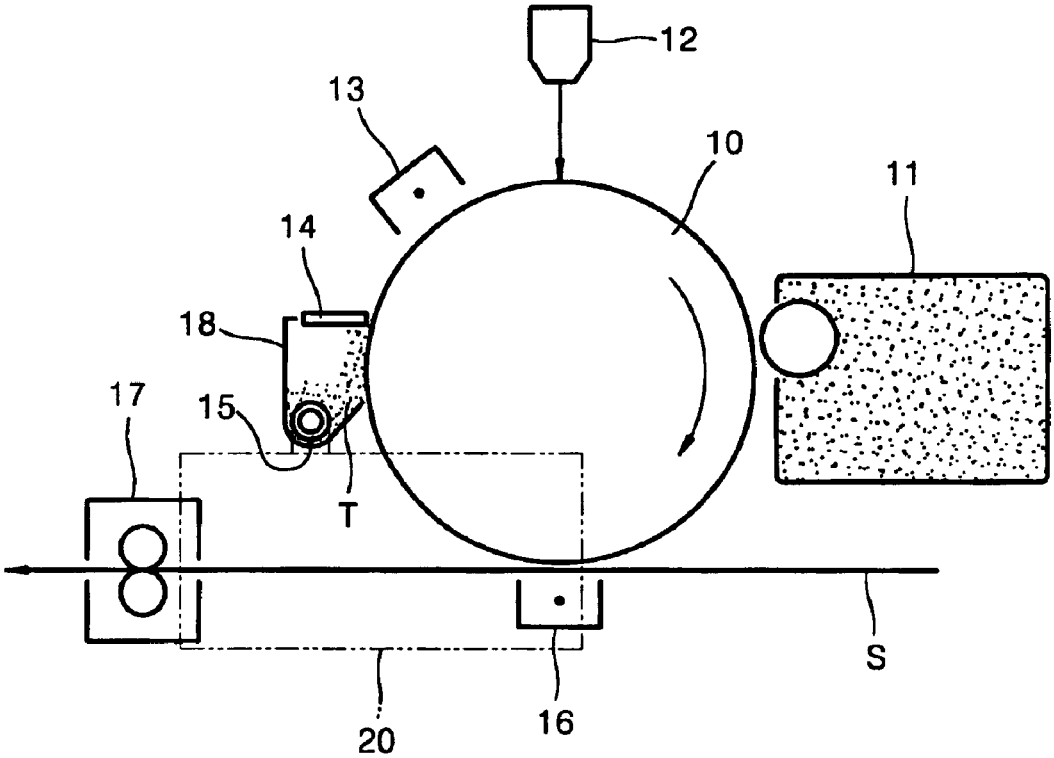
FIG. 1 (PRIOR ART)
FIG. 1 is a schematic view showing one example of a dry type electrophotographic image forming apparatus.
Figure 2:
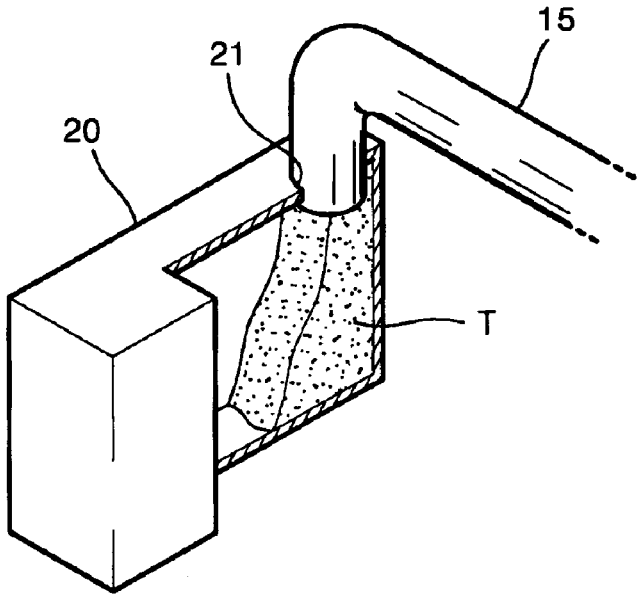
FIG. 2 (PRIOR ART)
FIG. 2 is a perspective view of a wasted toner container shown in FIG. 1.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
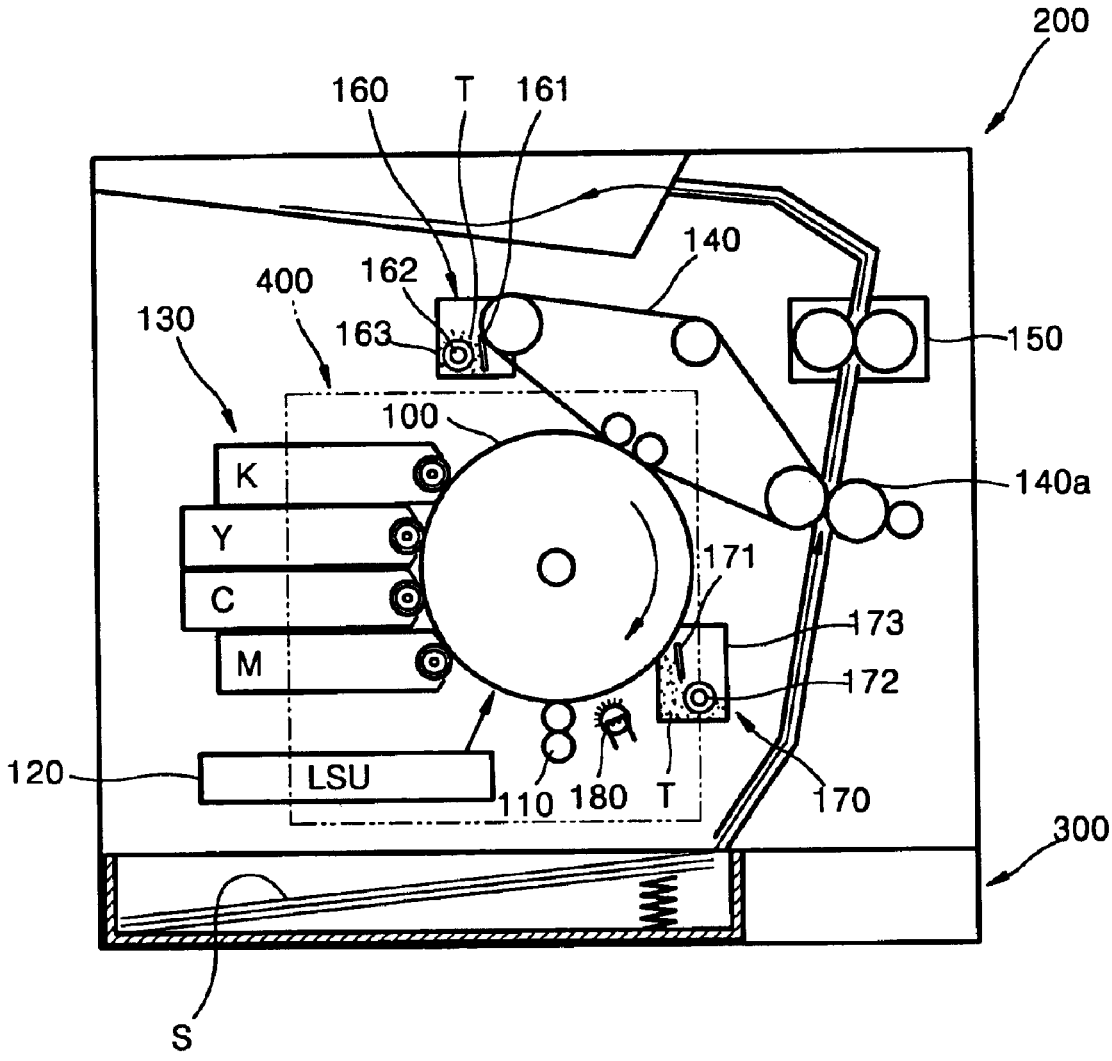
FIG. 3 is a schematic view showing one example of a dry type electrophotographic image forming apparatus adopting a wasted toner storing apparatus according to an embodiment of the present invention.

With reference to FIG. 3, a print unit 200 of an image forming apparatus includes a photoreceptor drum 100 as a photosensitive medium, a charger 110 for charging the photoreceptor drum 100, a laser scanning unit (LSU) 120 as an exposing unit for scanning light onto the charged photoreceptor drum 100 to form an electrostatic latent image of a desirable image, a developing unit 130 for developing the electrostatic latent image with toner, in a powder state, having the four colors of yellow (Y), magenta (M), cyan (C), and black (K) to form a toner image, a transferring unit having a transfer belt 140 for superimposing the toner images of four colors formed on the photoreceptor drum 100 sequentially and transferring the superimposed image to a sheet of print paper S, and a fixing unit 150 for heating and pressing the print paper S to fix the image on the print paper S. Reference numeral 170 represents a cleaning device for a photoreceptor drum, reference numeral 180 represents an eraser, and reference numeral 160 represents a cleaning device for a transfer belt. A feeding cassette 300 for supplying the print papers is installed at the lower portion of the print unit 200. The feeding cassette 300 is installed to be removable from the print unit 200 so as to accommodate a large amount of print paper.

In the above structure, a color image is formed as follows. Firstly, if the photoreceptor drum 100 is charged by the charger 110, the LSU 120 scans light onto the photoreceptor drum 100 to form an electrostatic latent image corresponding to a first color to be developed. For example, if yellow (Y) is determined as the first color, the developing unit 130-Y corresponding to yellow accesses the photoreceptor drum 100 and develops the electrostatic latent image formed on the photoreceptor drum 110 with yellow toner to form a yellow toner image. The yellow image thus formed is transferred to the transfer belt 140.

Next, an electrostatic latent image corresponding to a second color to be developed is formed by the charging and the exposure performed by the photoreceptor drum 100. For example, if magenta (M) is determined as a second color, the developing unit 130-M corresponding to magenta accesses the photoreceptor drum 100 and develops the electrostatic latent image formed on the photoreceptor drum 100 with magenta toner to form a magenta toner image. The magenta image thus formed is superimposed on and transferred to the transfer belt 140, to which the yellow image has been transferred. Cyan and black are also developed and transferred sequentially using the above-described method to form a final image of a desirable color on the transfer belt 140. Thereafter, the color image thus formed is transferred to the print paper S, which is supplied between the transfer belt 140 and a transfer back-up roller 140*a* from the feeding cassette 300, and is heated and pressed when passed through the fixed unit 150 so that the color image is completely fixed on the print paper S.

In the image formation process as described above, when the toner image is transferred from the photoreceptor drum 100 to the transfer belt 140, or from the transfer belt 140 to the print paper S, a portion of the toner for forming an image is not transferred, and remains on the photoreceptor drum 100 and the transfer belt 140. The remaining toner must be removed before the next print job. For this removal work, the cleaning unit 170 for the photoreceptor drum 100 and the cleaning unit 160 for the transfer belt 140 are provided.

The cleaning unit 170 for the photoreceptor drum 100 removes the toner remaining on the surface of the photoreceptor drum 100 after the toner image is transferred from the photoreceptor drum 100 to the transfer belt 140. The cleaning unit 170 for the photoreceptor drum 100 includes a first cleaning member 171 contacting the surface of the photoreceptor drum 100, a first container 173 for temporarily collecting the removed wasted toner T, and a first transporting unit 172 for transporting the wasted toner T to a wasted toner container 400. The cleaning unit 160 for the transfer belt 140 removes the toner remaining on the surface of the transfer belt 140 after the toner image is transferred from the transfer belt 140 to the print paper S. The cleaning unit 160 for the transfer belt 140 includes a second cleaning member 161 contacting the surface of the transfer belt 140, a second container 163 for temporarily collecting the removed wasted toner T, and a second transporting unit 162 for transporting the wasted toner T to the wasted toner container 400. The wasted toner T, which is removed from the photoreceptor drum 100 and the transfer belt 140, and is collected in the first container 173 and the second container 163, is transported to the wasted toner container 400 by the first transporting unit 172 and the second transporting unit 162.

Figure 4:
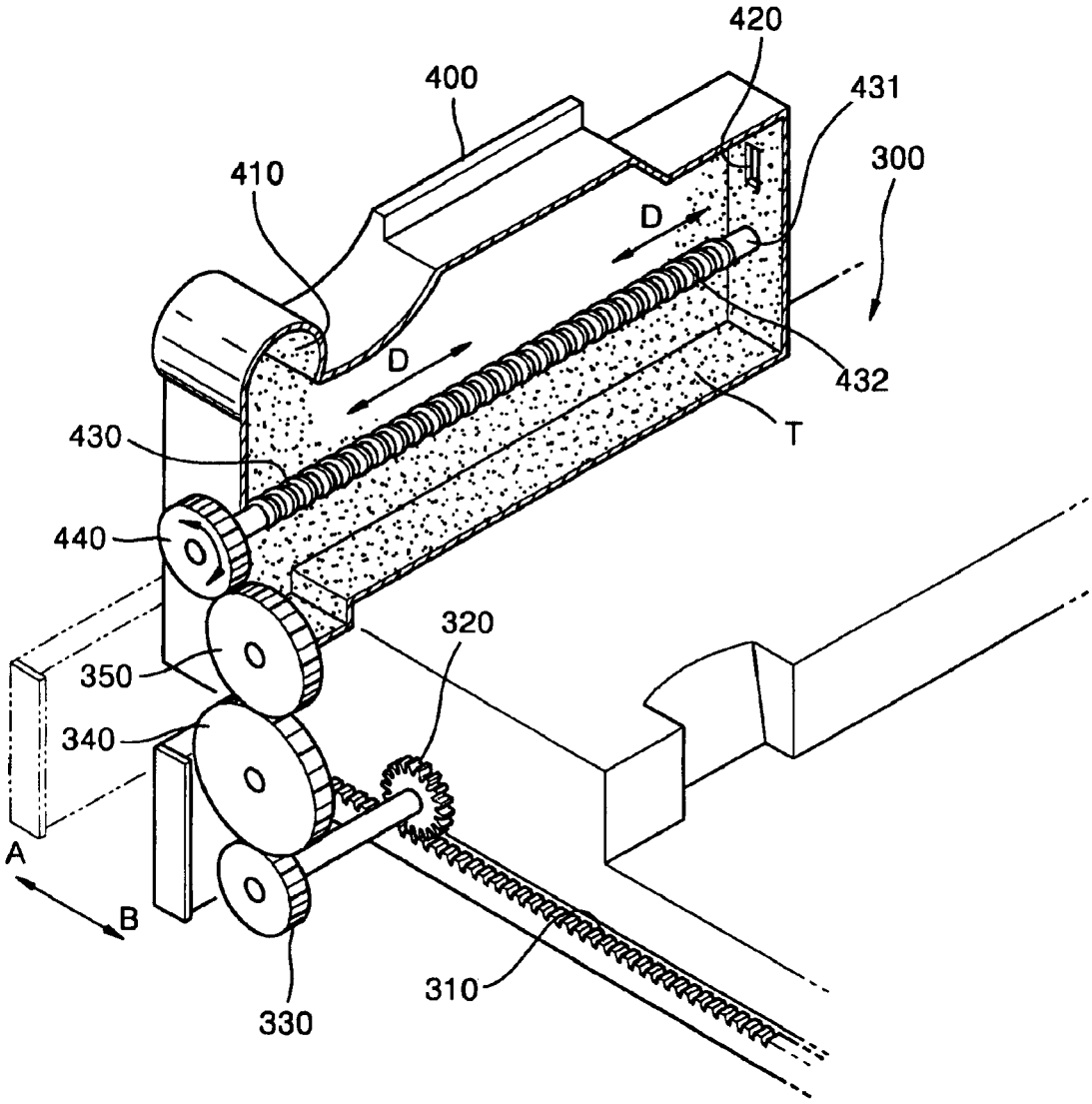
FIG. 4 is a perspective view of the wasted toner storing apparatus shown in FIG. 3.

FIG. 4 is a perspective view of a wasted toner storing apparatus shown in FIG. 3.

As shown in FIG. 4, the wasted toner storing apparatus includes the wasted toner container 400 provided with a first inlet 410, a second inlet 420, and a dispersing member 430 installed inside the wasted toner container 400. One end of the first transporting unit 172 and one end of the second transporting unit 162 are fitted to the first inlet 410 and the second inlet 420, respectively. Thus, the wasted toner T is transported from the first container 173 and the second container 163 to the wasted toner container 400 by the first inlet 410 and the second inlet 420, respectively. The dispersing member 430 includes a rotatable rotation axis 431 installed inside the wasted toner container 400, and a plurality of spiral wings 432 formed on the rotation axis 431. A first gear 440 is coupled to one end of the rotation axis 431 protruding outside the wasted toner container 400. The first gear 440 is one example of a power transmitting unit rotating the dispersing member 430.

The dispersing member 430 does not always have to rotate. Rather, it may be preferable that the dispersing member 430 rotates occasionally in order to disperse the accumulated wasted toner T, when a considerable amount of wasted toner T has accumulated around the inlets 410 and 420. Such an embodiment of the present invention is shown in FIG. 4. The dispersing member 430 is configured to rotate interlocking with the movement of the feeding cassette 300. A rack gear 310 is formed on the one side of the feeding cassette 300 in the movement direction of the feeding cassette 300, and the rack gear 310 is engaged with a pinion 320. The first gear 440 is connected to the pinion 320 by driven gears 330, 340, and 350.

In the above-described structure, if the feeding cassette 300 is pulled out in the A direction, as indicated in FIG. 4, for filling the print paper, the horizontal motion of the rack gear 310 is changed into a rotary motion by the pinion 320, and the rotary motion is transmitted to the first gear 440, whereby the dispersing member 430 rotates. If the feeding cassette 300 is pushed in the B direction, as indicated in FIG. 4, after filling the print paper, the dispersing member 430 rotates in the opposite direction of the rotation direction when the feeding cassette 300 is pulled out. If the dispersing member 430 rotates in both directions, the wasted toner T accumulated around the inlets 410 and 420 is transported in both directions, as indicated by D in FIG. 4, by the spiral wings 432. Thus, since the wasted toner T is evenly dispersed inside the wasted toner container 400, the inlets 410 and 420 are prevented from being clogged. Since 100–250 sheets of print paper can generally be filled in the feeding cassette 300, the wasted toner accumulated inside the wasted toner container 400 is dispersed in every print period of 100–250 sheets of print paper.

In addition to the above-described structure, the first gear 440 may be connected to a separate driving device (not shown) having a driving motor (not shown) for rotating the dispersing member 430, or may be connected to a driving device (not shown) for driving the photoreceptor drum 100 and the transfer belt 140. Various devices other than the gear, for example, a belt, may be used as a power transmitting unit.

Although the color image forming apparatus using the transfer belt as a transferring unit is described in this embodiment of the present invention, the present invention is not limited thereto. That is, the wasted toner storing apparatus according to the present invention can be adopted in most electrophotographic image forming apparatuses using dry toner. Therefore, the wasted toner storing apparatus according to the present invention can be adopted in not only color image forming apparatuses but also mono image forming apparatuses.

As described above, the wasted toner storing apparatus of the dry type electrophotographic image forming apparatus according to the present invention has several advantages, some of which are listed below.

First, since wasted toner is transported in both directions by rotating the dispersing member installed inside the wasted toner container without vibrating the wasted toner container, the inlets of the wasted toner container can be prevented from being clogged.

Second, since the dispersing member rotates only inside the wasted toner container, and the wasted toner container itself does not vibrate with the dispersing member, the first and second inlets and the first and second transporting units of the wasted toner container can be prevented from being separated from each other, thereby preventing the wasted toner from leaking.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A wasted toner storing apparatus of a dry type electrophotographic image forming apparatus, comprising:

a wasted toner container, with multiple inlets through which wasted toner enters the wasted toner container, which accommodates wasted toner that is generated by a print unit that prints an image on a print paper by an electrophotographic method using dry toner; and a dispersing member inside the wasted toner container, dispersing the wasted toner from the multiple inlets inside the wasted toner container by rotation of the dispersing member.

2. The wasted toner storing apparatus of claim 1, wherein the dispersing member comprises:

a rotation axis inside the wasted toner container; and a plurality of spiral protrusions disposed on the rotation axis to disperse the wasted toner.

3. The wasted toner storing apparatus of claim 1, further comprising a gear coupled to one end of the dispersing member;

wherein the dispersing member is rotated by a power applied to the gear coupled to one end of the dispersing member, the one end protruding outside the wasted toner container.

4. The wasted toner storing apparatus of claim 3, further comprising:

a separate driving device; and a driving motor;

wherein the power applied to the gear is supplied by the separate driving device, and the separate driving device is coupled to the driving motor.

5. The wasted toner storing apparatus of claim 3, further comprising:

a photoreceptive drum;

a transfer belt; and a driving device driving the photoreceptive drum and the transfer belt;

wherein the gear is coupled to the driving device.

6. A wasted toner storing apparatus of a dry type electrophotographic image forming apparatus, comprising:

a wasted toner container which accommodates wasted toner that is generated by a print unit that prints an image on a print paper by an electrophotographic method using dry toner and a dispersing member inside the wasted toner container, dispersing the wasted toner inside the wasted toner container by rotation of the dispersing member, wherein the dispersing member is coupled with a feeding cassette accommodating the print paper to be supplied to the print unit, and this coupling causes the rotation of the dispersing member during an installing/removing operation of the cassette.

7. The wasted toner storing apparatus of claim 6, further comprising a rack gear positioned on the feeding cassette in the installing/removing direction of the feeding cassette, wherein the dispersing member rotates by power transmitted from the rack gear when the feeding cassette is installed/removed.

8. The wasted toner storing apparatus of claim 7, wherein the dispersing member comprises:

a rotation axis inside the wasted toner container that is rotated by the rack gear; and a plurality of spiral protrusions which are installed on the rotation axis to disperse the wasted toner.

9. A dry type electrophotographic image forming apparatus comprising:

a print unit printing an image on a print paper by an electrophotographic method using dry toner; and a wasted toner storing apparatus storing wasted toner generated in the print unit, wherein the wasted toner storing apparatus comprises:

a wasted toner container accommodating the wasted toner;

multiple inlets through which wasted toner enters the wasted toner container; and a dispersing member inside the wasted toner container, dispersing the wasted toner from the multiple inlets inside the wasted toner container by rotation of the dispersing member.

10. The dry type electrophotographic image forming apparatus of claim 9, wherein the dispersing member comprises:

a rotation axis inside the wasted toner container; and a plurality of spiral protrusions disposed on the rotation axis to disperse the wasted toner.

11. The dry type electrophotographic image forming apparatus of claim 9, further comprising a gear;

wherein the dispersing member is rotated by a power applied to the gear coupled to one end of the dispersing member, the one end protruding outside the wasted toner container.

12. The dry type electrophotographic image forming apparatus of claim 11, further comprising:

a separate driving device; and a driving motor wherein the power applied to the gear is supplied by the separate driving device, and the separate driving device is coupled to the driving motor.

13. The dry type electrophotographic image forming apparatus of claim 11, further comprising a photoreceptive drum;

a transfer belt; and a driving device driving the photoreceptive drum and the transfer belt;

wherein the gear is coupled to the driving device.

14. A dry type electrophotographic image forming apparatus comprising:

a print unit printing an image on a print paper by an electrophotographic method using dry toner; and a wasted toner storing apparatus storing wasted toner generated in the print unit, wherein the wasted toner storing apparatus comprises:

a wasted toner container accommodating the wasted toner; and a dispersing member inside the wasted toner container, dispersing the wasted toner inside the wasted toner container by rotation of the dispersing member, the image forming apparatus further comprising a feeding cassette accommodating the print paper to be supplied to the print unit, wherein the dispersing member is coupled with the cassette, and this coupling causes the rotation of the dispersing member during an installing/removing operation of the feeding cassette.

15. The dry type electrophotographic image forming apparatus of claim 14, further comprising a rack gear;

wherein the rack gear is formed in the feeding cassette in the installing/removing direction of the feeding cassette, and the dispersing member rotates by power transmitted from the rack gear when the feeding cassette is installed/removed.

16. The dry type electrophotographic image forming apparatus of claim 15, wherein the dispersing member comprises:

a rotation axis inside the wasted toner container that is rotated by the rack gear and a plurality of spiral protrusions which are installed on the rotation axis to disperse the wasted toner.

* * * * *

UNITED STATES PATENT AND TRADEMARK OFFICE

CERTIFICATE OF CORRECTION

PATENT NO. : 6,873,819 B2
DATED : March 29, 2005
INVENTOR(S) : Byeong-hwa Ahn et al.

It is certified that error appears in the above-identified patent and that said Letters Patent is hereby corrected as shown below:

Column 6,
Line 57, insert -- ; -- after “toner”.

Column 7,
Line 43, insert -- ; -- after “motor”.

Column 8,
Line 40, insert -- ; -- after “gear”.

Signed and Sealed this

Twentieth Day of December, 2005

JON W. DUDAS
*Director of the United States Patent and Trademark Office*